US006152498A

United States Patent [19]

Lindqvist

[11] Patent Number: 6,152,498

[45] **Date of Patent: *Nov. 28, 2000**

[54] LATCH ASSEMBLY

[75] Inventor: Per Olof Lindqvist, Onsala, Sweden

[73] Assignee: FIX AB, Gothenburg, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,904

[22] Filed: Feb. 5, 1998

[51] Int. Cl.[7] ..... E05C 3/06

[52] U.S. Cl. ..... 292/53; 292/96; 292/195

[58] Field of Search ..... 292/53, 97, 96, 292/196, 195, DIG. 24, 5, 8, 49, 98, 197; 70/114, 116, 121, 127

[56] References Cited

U.S. PATENT DOCUMENTS

| | | | |
|---|---|---|---|
| 51,059 | 11/1865 | Jordan | 292/98 |
| 1,895,892 | 1/1933 | Moore | 292/DIG. 24 |
| 3,695,068 | 10/1972 | Eads et al. | 70/107 |
| 3,788,679 | 1/1974 | Banham | 292/40 |
| 4,218,903 | 8/1980 | Eads | 70/107 |
| 4,518,178 | 5/1985 | Bengtsson | 292/8 |
| 4,548,432 | 10/1985 | Bengtsson | 292/8 |
| 4,643,005 | 2/1987 | Logas | 70/95 |
| 4,961,602 | 10/1990 | Pettersson | 292/98 |
| 5,244,238 | 9/1993 | Lindqvist | 292/7 |
| 5,452,925 | 9/1995 | Huang | 292/57 |
| 5,452,927 | 9/1995 | Uyeda | 292/202 |
| 5,622,065 | 4/1997 | Persiano | 70/139 |
| 5,820,170 | 10/1998 | Clancy | 292/26 |

FOREIGN PATENT DOCUMENTS

| | | | |
|---|---|---|---|
| 2620482 | 3/1989 | France | 292/5 |
| 1184157 | 3/1970 | United Kingdom | 292/5 |

*Primary Examiner*—B. Dayoan
*Assistant Examiner*—Clifford B Vaterlaus
*Attorney, Agent, or Firm*—Samuels, Gauthier & Stevens, LLP

[57] ABSTRACT

A latch assembly for installation in a recess along a side edge of a wing element, for covering or uncovering an aperture, the latch assembly being adapted to hold the wing element in a closed position. The assembly includes a housing having at least one wall, at least one espagnolette bolt and an espagnolette rod. The espagnolette bolt is slidingly arranged in the housing between a first open position, in which the espagnolette bolt is retracted into the housing, and a second latching position, in which the espagnolette bolt projects from the housing to engage with a catch. The espagnolette bar is operatively connected to the espagnolette bolt for maneuvering the espagnolette bolt between the first open position and the second latching position. A latching pin is arranged for displacement with the espagnolette bolt, during movement of the espagnolette bolt from the first open position to the second latching position and back. The latching pin is movably arranged in a guiding slot arranged in at least one of the at least one wall of the housing.

5 Claims, 4 Drawing Sheets

LATCH ASSEMBLY

TECHNICAL FIELD

The present invention relates to a latch assembly for maintaining closures such as doors, windows, shutters, etc., in a closed position.

BACKGROUND OF THE INVENTION

Known latch assemblies for the opening/closing and locking of closures of the type in which at least one bolt is manoeuvred using a handle are shown in, for example, U.S. Pat. No. 4,548,432 (Bengtsson), hereby incorporated by reference. The assembly comprises a lock casing attached to an espagnolette edge bar. The lock casing contains a locking and manoeuvring mechanism. The bar and the lock casing are mounted in a recess in, for example, a door. An espagnolette rod is displaceable along the door edge and is arranged as a latching rod for manoeuvring at least one espagnolette bolt. A handle in the locking and manoeuvring mechanism acts on a bevelled bolt and the espagnolette rod. When the handle is in a rest position, the espagnolette bolt is retracted into an espagnolette edge bar recess while the bevelled bolt is extended. In a locking position, the espagnolette bolt is extended out from the espagnolette edge bar recess to cooperate with a locking element affixed to, for example, a door frame surrounding the door.

Although the above-described latch assembly has been shown to operate satisfactorily, at least two apparent drawbacks are associated with the assembly.

Firstly, when the assembly is in the locking position, any force exerted on the espagnolette bolt or the espagnolette rod, for example by an intruder trying to break open the closure, is transmitted to the locking and manoeuvring mechanism via the espagnolette rod. The locking and manoeuvring mechanism thus has to be made sufficiently robust to withstand this force in order for the locking function to be maintained. This results in a heavy and expensive construction of the locking and manoeuvring mechanism.

Secondly, should the espagnolette rod be cut through from outside the door, for example by an intruder, and the thus severed espagnolette rod parts are pushed apart from each other, the at least one espagnolette bolt may fall under the effect of gravity from its locked position to an opened position in which it is drawn into the espagnolette edge bar recess, thus facilitating unauthorized opening of the door.

SUMMARY OF THE INVENTION

It is therefore an object of the invention to provide a latch assembly which prevents external forces exerted on either the espagnolette bolt or the espagnolette rod from being transmitted to the locking and manoeuvring mechanism, and further to provide a latch assembly which maintains the espagnolette bolt in a locking position even if the espagnolette rod should be cut or removed, to thereby obviate said drawbacks of the known prior art.

The above-mentioned object is accomplished in accordance with the present invention by a latch assembly for installation in a recess along a side edge of a wing element, for covering or uncovering an aperture, wherein the latch assembly is adapted to hold the wing element in a closed position, the assembly comprising:

a housing having at least one wall;

at least one espagnolette bolt being slidingly arranged in the housing between a first open position, wherein the espagnolette bolt is retracted into the housing, and a second latching position, wherein the espagnolette bolt projects from the housing to engage with a catch;

an espagnolette rod operatively connected to the espagnolette bolt for manoeuvring the espagnolette bolt between the first open position and the second latching position; and a latching pin arranged for displacement with the espagnolette bolt, during movement of the espagnolette bolt from the first open position to the second latching position and back;

wherein the latching pin is movably arranged in a guiding slot having a perimeter wall, said guiding slot being arranged in at least one of the at least one wall of the housing, the guiding slot comprising a first portion, shaped to allow the latching pin to slidingly move from a first position, at which the espagnolette bolt is in its first open position, to an intermediate position at which the espagnolette bolt is approaching its second latching position, and a second portion shaped to allow the latching pin to assume a third locking position in which the espagnolette bolt is locked in its second latching position by action of the latching pin against the perimeter wall of the guiding slot in the wall of the housing.

The espagnolette rod, when manoeuvring the espagnolette bolt from the latching position towards the open position, also manoeuvres the latching pin from its third locking position to its intermediate position and further towards its first position.

BRIEF DESCRIPTION OF THE DRAWINGS

The invention will be described in greater detail by way of example only and with reference to particular embodiments illustrated in the annexed drawings, in which.

DETAILED DESCRIPTION OF PREFERRED EMBODIMENTS

Figure 1:
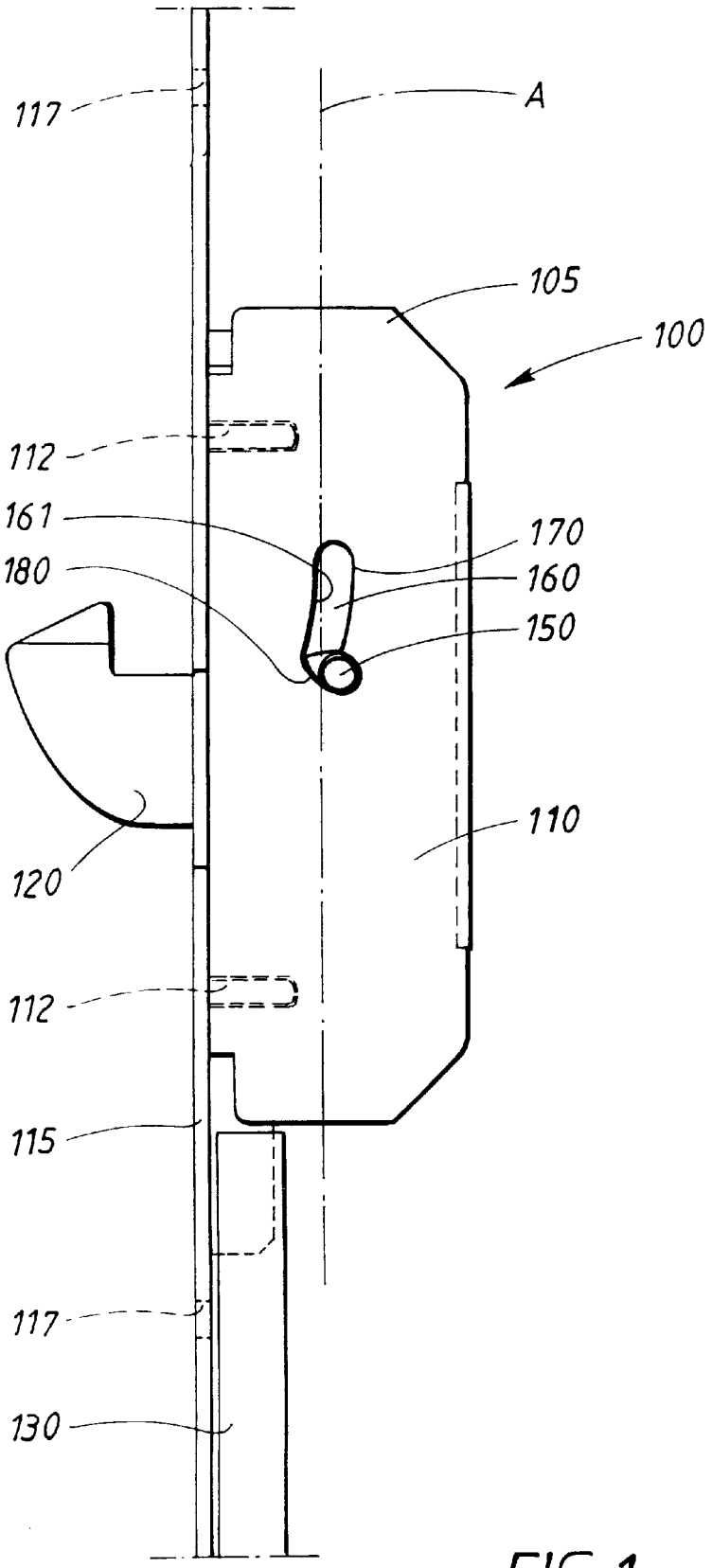
FIG. 1 shows a schematic side view of a latch assembly according to the present invention.

In FIG. 1, reference numeral 100 generally denotes a latch assembly according to one embodiment of the present invention. The latch assembly comprises a housing 105, having at least one wall 110, preferably two opposed walls.

Figure 4:
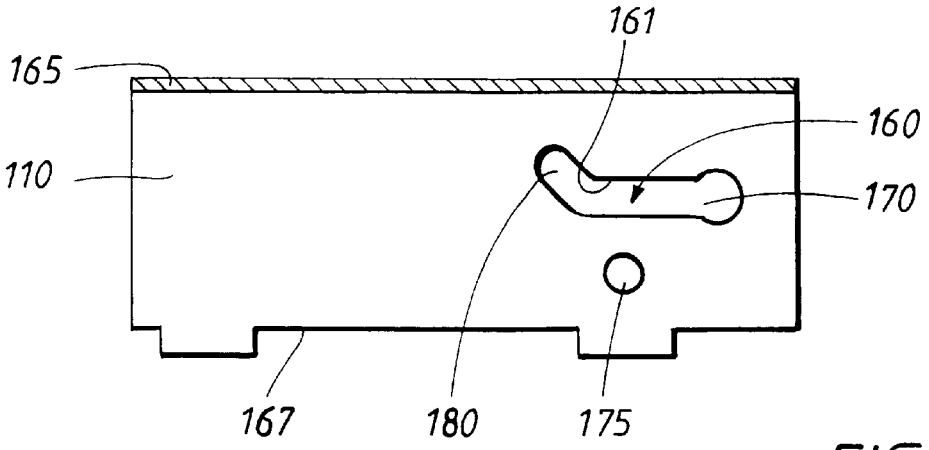
FIG. 4 is a schematic side view of a side wall of a housing of one embodiment of the latch assembly according to the present invention.

The wall 110 is shown in FIG. 4, separated from the latch assembly. The wall 110 comprises a first side 165 and a second side 167 arranged opposite to the first side. The first side 165 faces a wing element (not shown), for example a door or a window. The housing 105 is arranged to be mounted in a recess (not shown) in the wing element.

FIG. 1 further shows an espagnolette edge bar 115 which is attached to the housing 100 using attachment means 112, for example screws. The espagnolette edge bar 115 is mounted flat against a side of the wing element, for example using screws (not shown) fastened to the wing element and running through mounting holes 117 arranged in the espagnolette edge bar, with the attached housing 105 mounted in the recess as described above.

Figure 3A:
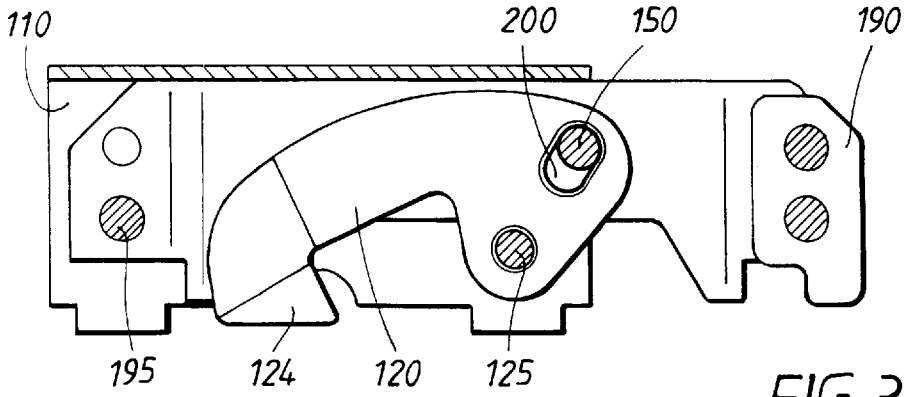
FIG. 3*a* is a schematic side view of another part of the latch assembly according to the present invention.
Figure 6:
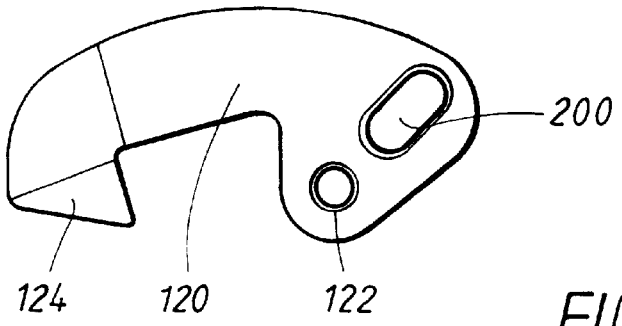
FIG. 6 is a schematic side view of an espagnolette bolt of one embodiment of the latch assembly according to the present invention.
Figures 8A, 8B, 8C:
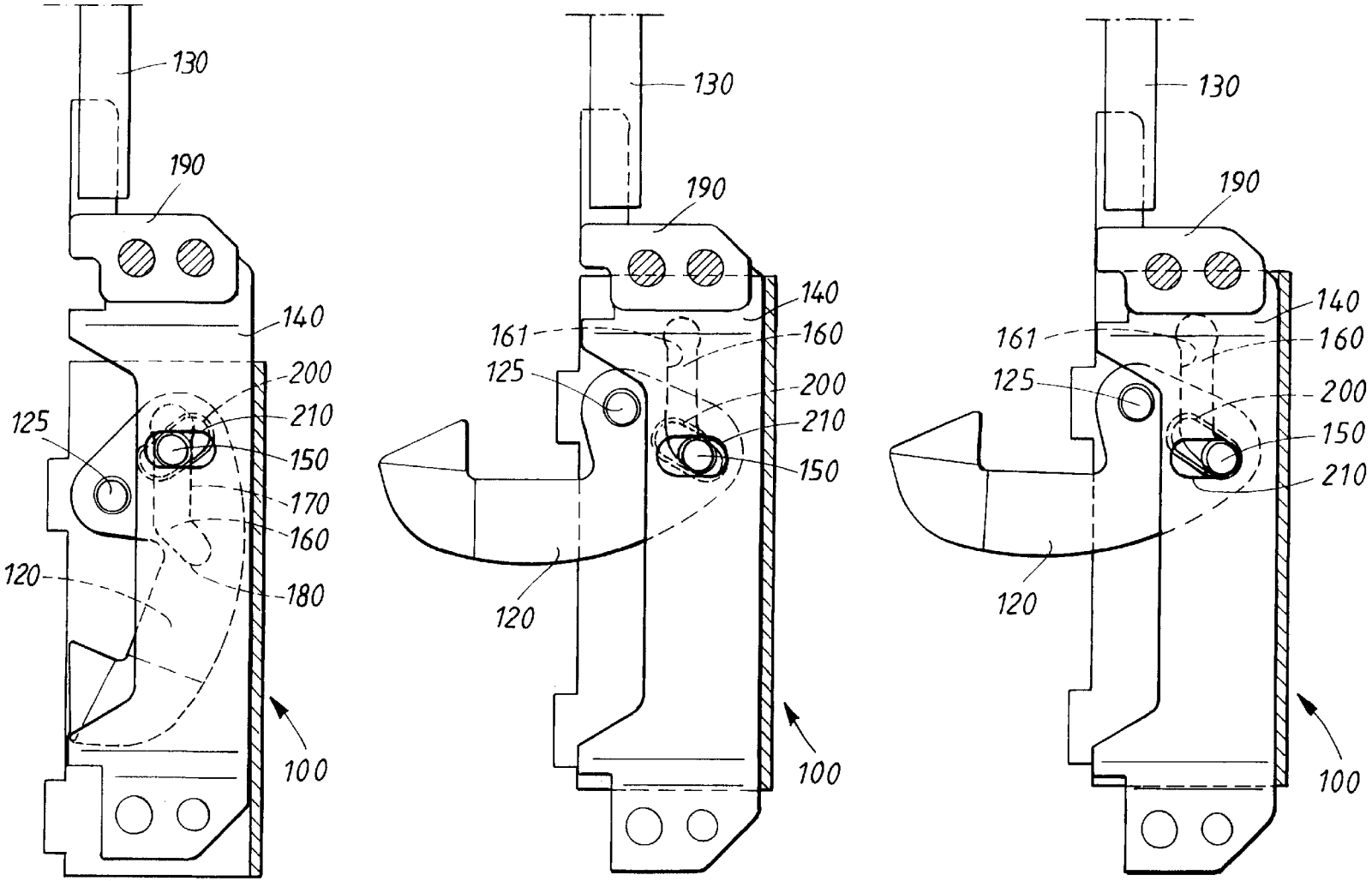

The latch assembly further comprises at least one espagnolette bolt 120 which is slidingly arranged in the housing 105, for example about a pivot pin 125 (as shown in FIG. 3*a*), between a first open position (as illustrated in FIG. 8*a*), wherein the espagnolette bolt 120 is retracted into the housing 105, and a second latching position (as illustrated in FIGS. 1 and 8*c*), wherein the espagnolette bolt 120 extends from the housing 105 and engages with a catch (not shown), advantageously mounted on a suitable location in a door frame or window frame surrounding the door or window. The espagnolette bolt 120, shown separated from the latch assembly in FIG. 6, comprises a through hole 122, which slidingly accommodates the pivot pin 125, and a first end 124, advantageously having a hook shape. The wall 110 of the housing 105, as shown in FIG. 4, is provided with a mounting hole 175 for accommodating and holding the pivot pin 125.

The espagnolette bolt 120 is shown in FIG. 1 as being rotatable around the pivot pin 125, though instead it may be linearly movable in and out of the housing 100 in a direction perpendicular to a longitudinal axis A of the housing 100.

An espagnolette rod 130 is operatively connected to the espagnolette bolt 120, via a connecting mechanism 140 (as shown in FIGS. 8*a–c*), for manoeuvring the espagnolette bolt 120 between the first open position and the second latching position. The espagnolette rod 130 has a direction of extension substantially parallel to the espagnolette edge bar 115. Like the espagnolette bolt 120, the espagnolette rod 130 is advantageously made of a hard yet ductile material, for example hardened steel. The rod is preferably in the form of a strip of material. The connecting mechanism 140, shown separated from the latch assembly in FIG. 5, comprises a first end 142, a second end 144 and a central portion 146.

Figure 3B:
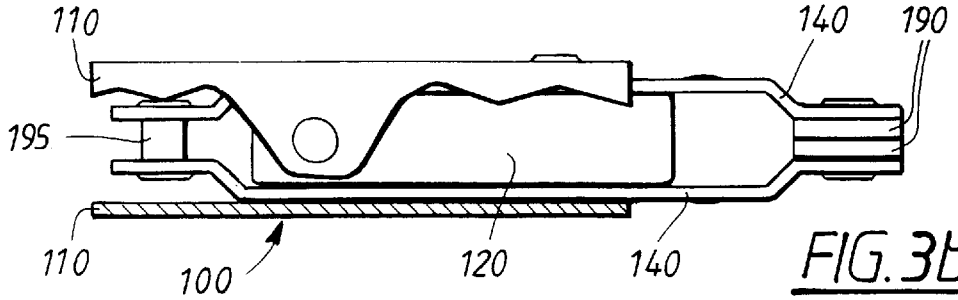
FIG. 3*b* is a plan view of the latch assembly of FIG. 3*a;*

In a preferred embodiment of the invention, and as shown in FIG. 3*b*, the latch assembly comprises two opposed walls 110, fastened together using spacer means (not shown) to form the housing 105, and two opposed connecting mechanisms 140, fastened together using spacer means 195, slidingly arranged inside the housing.

A latching pin 150 is arranged for displacement with the espagnolette bolt 120, during movement of the espagnolette bolt 120 from the first open position to the second latching position and back. The latching pin 150 is movably arranged in a guiding slot 160 arranged in at least one of said at least one wall 110 of the housing 105. The guiding slot 160 has a double arc shape and is delimited by a perimeter wall 161. The guiding slot extends in a direction generally parallel to the direction of extension of the espagnolette rod 130.

Figure 7:
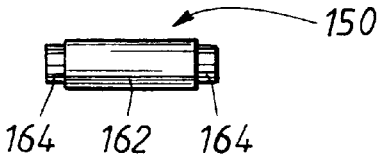
FIG. 7 is a schematic side view of a latching pin of one embodiment of the latch assembly according to the present invention, and FIGS. 8 *a–c* are schematic side views of a latch assembly according to the present invention showing the deployment of the espagnolette bolt.

The latching pin 150, as shown in FIG. 7, is preferably formed having a larger diameter body portion 162 and at least one smaller diameter portion 164 at one end of the latching pin, the smaller diameter portion having a diameter adapted to fit in the guiding slot 160. In a preferred embodiment, the latching pin 150 has two small diameter portions 164, situated at each end of the latching pin. Preferably, a guiding slot 160 is formed in each of the opposing walls, whereby the latching pin 150, having small diameter portions 164 at each of its two ends, extends through the housing and engages both guiding slots.

The guiding slot 160 comprises a first portion 170, shaped to allow the latching pin 150 to slidingly move from a first position, at which the espagnolette bolt 120 is in its first open position (see FIG. 1 and 8*a*), to an intermediate position (see FIG. 8*b*) at which the espagnolette bolt 120 is approaching its second latching position, and a second portion 180 shaped to allow the latching pin 150 to assume a third locking position in which the espagnolette bolt 120 is locked in its second latching position by action of the latching pin 150 gainst the perimeter wall 161 of the guiding slot 160 in the wall 110 of the housing 105 (see FIG. 8*c*).

The espagnolette rod 130, when manoeuvring the espagnolette bolt 120 from the latching position towards the open position, also manoeuvres the latching pin 150 from its third locking position to its intermediate position and further towards its first position.

Figure 2A:
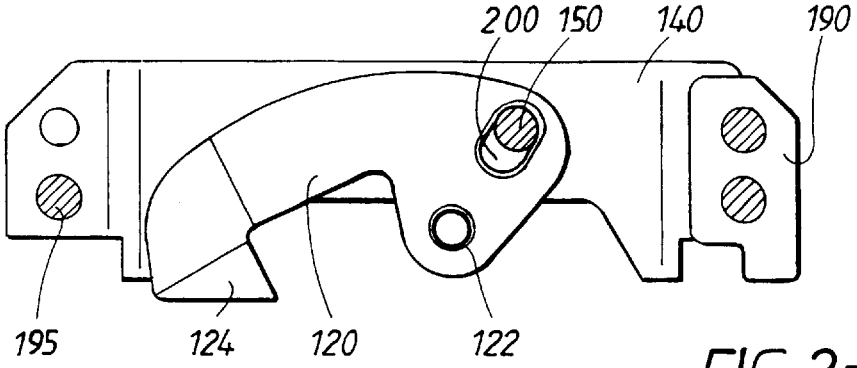
FIG. 2*a* is a schematic side view of a part of the latch assembly according to the present invention.
Figure 2B:
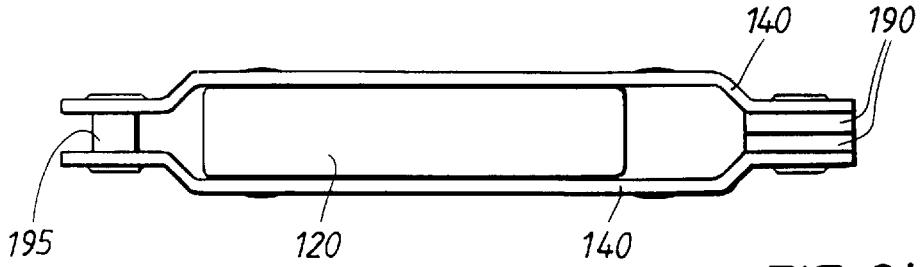
FIG. 2*b* is a plan view of the latch assembly of FIG. 2*a;*
Figure 5:
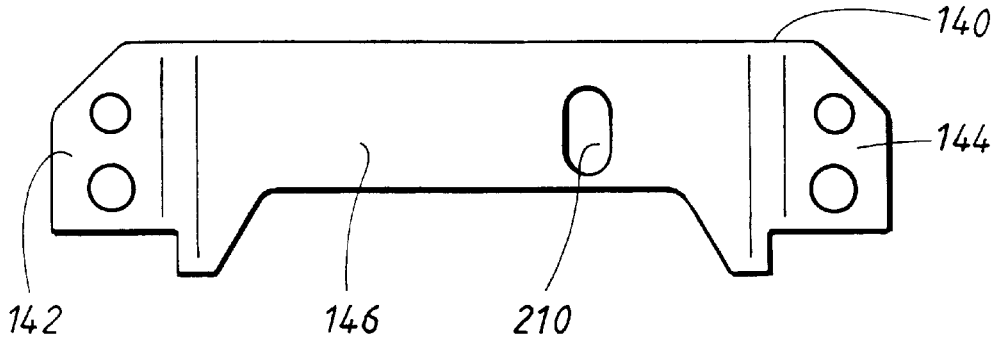
FIG. 5 is a schematic side view of a connecting mechanism of one embodiment of the latch assembly according to the present invention.

As is shown in FIGS. 2*a* and 5, the connecting mechanism 140 comprises an attachment 190 for the espagnolette rod 130. The connecting mechanism 140 further comprises an elongated through hole 210 through which the latching pin 150 passes. The through hole 210 is dimensioned so as to allow the latching pin 150 to move relative to the connecting mechanism. The espagnolette bolt 120 comprises a slot 200 through which the latching pin 150 passes for cooperating with the latching pin 150 and the pivot pin 125, during movement of the connecting mechanism 140 by the espagnolette rod 130, to allow the espagnolette bolt 120 to move from its first open position to its second latching position and back.

FIGS. 2*a*, 3*a* and 8*a* show the espagnolette bolt 120 in its first open position, i.e. the door or window is unlocked. By moving the espagnolette rod 130 to the left in FIG. 2*a*, the movement is transmitted to the espagnolette bolt 120 via the connecting mechanism 140 causing the latching pin 150 to act on the slot 200 in the espagnolette bolt 120. As a result, the espagnolette bolt 120 is caused to rotate about the pivot pin 125 to move the espagnolette bolt 120 towards its second latching position.

FIG. 8*b* shows the latching pin 150 in its intermediate position at which the espagnolette bolt 120 has reached its second latching position and the latching pin 150 is being moved towards its third locking position by gravitational forces acting upon the locking pin 150 and the force transmitted to the latching pin by the espagnolette rod 130.

FIG. 8*c* shows the latching pin 150 in its third locking position in which the espagnolette bolt 120 is locked in its second latching position by action of the latching pin 150 against the perimeter wall 161 of the guiding slot 160 in the wall 110 of the housing 105.

The espagnolette bolt 120 has been shown as being rotated about the pivot pin 125, but an alternative embodiment employs an espagnolette bolt which is moved in and out of the housing 100 in a linear motion (not shown in the drawings). The guiding slot 160, according to this embodiment, has to be angled with respect to the longitudinal axis A and the direction of travel of the espagnolette bolt 120.

Whilst the invention has been described above with respect to certain preferred embodiments thereof, the invention is not limited to these embodiments but may be varied within the scope of the appended claims. For example, more than one latch assembly may be connected in series to provide latching points along a greater length of the side of a door or a window. A second espagnolette bar is then connected to the connection mechanism, for example opposite the first espagnolette bar. The latching mechanism may also be integrated into the main lock of a door or a window, to provide an extra locking means in addition to the locking bolt of the lock. The latching pin has been described as substantially cylindrical and having two diameters, but it is also conceivable to use a latching pin having a noncircular cross-section, for example a square or rectangular cross-section.

What is claimed is:

1. A latch assembly for installation in a recess along a side edge of a wing element, for covering or uncovering an aperture, wherein said latch assembly is adapted to hold said wing element in a closed position, said assembly comprising:

a housing having at least one wall;

at least one espagnolette bolt, said espagnolette bolt being slidingly arranged in said housing between a first open position, wherein said espagnolette bolt is retracted into said housing, and a second latching position, wherein said espagnolette bolt projects from said housing to engage with a catch;

an espagnolette rod operatively connected to said espagnolette bolt for maneuvering said espagnolette bolt between said first open position and said second latching position; and a latching pin non-attachedly arranged for free displacement with said espagnolette bolt, during movement of said espagnolette bolt from said first open position to said second latching position and back;

wherein said latching pin is movably arranged in a guiding slot having a perimeter wall, said guiding slot being arranged in at least one of said at least one wall of said housing and being of a double arc shape and extending in a direction generally parallel to the extension of said espagnolette rod, said guiding slot comprising a first portion, shaped to allow said latching pin to slidingly move from a first position, at which said espagnolette bolt is in its first open position, to an intermediate position at which said espagnolette bolt is approaching its second latching position, and a second portion shaped to allow said latching pin to assume a third locking position in which said espagnolette bolt is locked in its second latching position by action of said latching pin against said perimeter wall of said guiding slot in said wall of said housing; and wherein said espagnolette bolt is provided with a slot which partially overlaps said guiding slot in at least one side wall of said housing such that said latching pin is constrained to slide laterally within said slot in said espagnolette bolt.

2. The latch assembly as claimed in claim 1, wherein said espagnolette rod, when manoeuvring said espiagnolette bolt from said latching position towards said open position, also manoeuvres said latching pin from its third locking position to its intermediate position and further towards its first position.

3. The latch assembly as claimed in claim 1, wherein said espagnolette bolt is arranged for pivotal displacement about a pivot pin in said housing.

4. The latch assembly as claimed in claim 1, wherein said housing comprises two opposed side walls having identical guiding slots, and said latching pin has an increased diameter portion and two reduced diameter portions at each end of said latching pin, said reduced diameter portions engaging said guiding slots and said increased diameter portion engaging said slot of said espagnolette bolt.

5. The latch assembly as claimed in claim 1, wherein a first portion of said guiding slot is shaped to allow said latching pin to slidingly move from said first position, at which said espagnolette bolt is in its first open position, to said intermediate position at which said espagnolette bolt is approaching its second latching position, and a second portion shaped to allow said latching pin to assume said third locking position in which said espagnolette bolt is locked in its second latching position by action of said latching pin against said perimeter wall of said guiding slot in said wall of said housing.

* * * * *